US006805458B2

(12) United States Patent
Schindler et al.

(10) Patent No.: US 6,805,458 B2
(45) Date of Patent: Oct. 19, 2004

(54) NIGHT LIGHT FOR PLUMBING FIXTURES

(75) Inventors: Robert J. Schindler, Euclid, OH (US); Srianath K. Aanegola, Parma Heights, OH (US); Greg E. Burkholder, Valley View, OH (US); Frank P. Dornauer, Valley City, OH (US); Mitchell J. Hart, Brook Park, OH (US); Kerry D. Moore, Medina, OH (US); James T. Petroski, Parma, OH (US); Tomislav J. Stimac, Concord, OH (US)

(73) Assignee: GELcore LLC, Valley View, OH (US)

( * ) Notice: Subject to any disclaimer, the term of this patent is extended or adjusted under 35 U.S.C. 154(b) by 0 days.

(21) Appl. No.: 10/064,772

(22) Filed: Aug. 15, 2002

(65) Prior Publication Data

US 2004/0032749 A1 Feb. 19, 2004

(51) Int. Cl.[7] ..... F21W 121/02; F21W 131/30
(52) U.S. Cl. ..... 362/96; 239/18; 362/101
(58) Field of Search ..... 362/96, 101, 800, 362/802, 145, 253; 239/18, 12

(56) References Cited

U.S. PATENT DOCUMENTS

| | | | | | |
|---|---|---|---|---|---|
| 4,564,889 | A | * | 1/1986 | Bolson | 362/96 |
| 4,749,126 | A | | 6/1988 | Kessener et al. | 239/12 |
| 4,901,922 | A | * | 2/1990 | Kessener et al. | 362/96 |
| 5,136,476 | A | * | 8/1992 | Horn | 362/198 |
| 5,148,824 | A | | 9/1992 | Wilson et al. | 137/3 |
| 5,171,429 | A | | 12/1992 | Yasuo | 210/94 |
| 5,611,089 | A | | 3/1997 | Cretors | 4/234 |
| 5,664,867 | A | | 9/1997 | Martin et al. | 362/101 |
| 5,763,872 | A | | 6/1998 | Ness | 250/214 AL |
| 6,021,960 | A | * | 2/2000 | Kehat | 362/96 |
| 6,126,290 | A | | 10/2000 | Veigel | 362/96 |
| 6,132,057 | A | | 10/2000 | Williams | 362/100 |
| 6,273,579 | B1 | | 8/2001 | Holloway | 362/100 |

* cited by examiner

*Primary Examiner*—Laura K. Tso
(74) *Attorney, Agent, or Firm*—Fay, Sharpe, Fagan, Minnich & McKee, LLP

(57) ABSTRACT

A showerhead (802, 804) or faucet (12, 602, 702) includes a water outlet (16, 606, 706, 802) for emitting a water flow (22, 610, 710) and a handle (18, 20, 604, 704, 830) for controlling the water flow (22, 610, 770). At least one LED (42, 242, 342, 442, 542, 544, 546, 624, 658, 730, 810) is arranged on or in the showerhead (802, 804) or faucet (12, 602, 702) and viewable by an associated user thereof. A light-transmissive encapsulant (630, 660, 732) seals the at least one LED (42, 242, 342, 442, 542, 544, 546, 624, 658, 730, 810) and transmits light produced by the at least one LED (42, 242, 342, 442, 542, 544, 546, 624, 658, 730, 810) to the associated user. A controller (550) produces a controller output for controlling the LED light emission responsive to at least one of a water flow rate, a water flow temperature, an ambient light level, and a position of the handle (18, 20, 604, 704, 830). The at least one LED (42, 242, 342, 442, 542, 544, 546, 624, 658, 730, 810) is can be arranged on a printed circuit board (626, 656) and electrically powered via conductive traces thereon, in which case the light-transmissive encapsulant (630, 660, 732) seals the LED source and the conductive traces.

32 Claims, 16 Drawing Sheets

NIGHT LIGHT FOR PLUMBING FIXTURES

BACKGROUND OF INVENTION

The invention relates to the lighting arts. It is especially applicable to the nocturnal illumination of bathroom plumbing fixtures such as faucets, showerheads, toilets, and the like which produce an accessible water flow, and will be described with particular reference thereto. However, the invention will also find application in the illumination of plumbing fixtures in other settings where operation in darkness or other conditions of poor visibility is encountered, in the lighting and operative status indication (e.g., temperature, flow rate, et cetera) of fluid conduits conducting accessible or inaccessible flow of water or another fluid, and in other similar applications.

Rooms such as bathrooms can be very dark at night. Turning on the room light at night is uncomfortable to the eyes due to darkness-induced pupil dilation, and full illumination at daytime levels is typically unnecessary due to improved light collection of the dilated pupils as well as the adequacy of limited visibility for most bathroom-related activities. It is thus desired to provide a lower level of illumination for a bathroom at night.

In the past various devices, known as night lights, have been used for illuminating bathrooms and other dark places at night. These night lights typically employ incandescent bulbs or fluorescent tubes to provide a reduced level of illumination as compared with daytime lighting. The reduced light level produced by the night light is sufficient for using the bathroom facilities without being so bright as to be intrusive, disorienting, or even painful to individuals with darkness-induced pupil dilation.

These past night lights have several disadvantages. They usually monopolize an electrical outlet. This is particularly problematic in modern bathrooms where a large number of electrical appliances are already employed, such as electric razors, hair dryers, air fresheners, and the like. In many such night lights, there is no power cable. Rather, the blades of the electrical plug are molded rigidly into the night light housing and the night light is affixed to the electrical outlet by the electrical plug blades. This can further limit the electrical outlet usage due to the size and unwieldiness of the affixed night light which not only occupies an outlet but also can block an adjacent outlet.

Past night lights are also not usually located in very close proximity to the bathroom sink, faucet, washbasin, showerhead, or other apparatus which is the destination of the night-wandering person's trek. As mentioned above, in many cases the night light is directly affixed to the electrical outlet by rigidly incorporated electrical plug blades. It is therefore located some distance away and does not illuminate the washbasin, toilet, or the like with good efficiency. Placement of conventional night lights near bathroom plumbing fixtures, especially faucets, is limited by safety concerns arising from an incompatibility of the 120 volt a.c. electrical power with the externally accessible water flow.

The spatial separation of past night lights from the washbasin also complicates the operation of the night light. In one operative method, the night light remains on constantly, or at least whenever the room is dark. This method wastes electricity, and can also produce stray light that can be annoying to sleeping individuals. Safety issues can also arise with an unattended conventional night light. In the case of an incandescent night light, a hot incandescent bulb is left unattended at night. In the case of a fluorescent night light, a source employing a high voltage electrical discharge is left unattended.

In another operative method, the night light is manually switched on and off as needed. This method requires that night-wandering person physically access the night light, which as mentioned before is typically not located very close to the target plumbing fixture. This method disadvantageously leaves the user unaided in locating the night light in the dark. Such a situation is not only inconvenient, but can also be dangerous as the person is left to blindly probe in search of the electrically energized device.

Yet another disadvantage of past night lights is that they are operatively disconnected from the associated plumbing fixture. For example, a conventional night light does not communicate with the washbasin faucet and cannot inform the user of its status. This can be problematic at night, because due to the reduced light levels (even with the night light) and the drowsy state of the night-wandering person, he or she is apt to be careless and run the faucet too hot or too cold, or at an undesirably high flow rate. A similarly dangerous situation can come to pass for an early-rising person attempting to take a shower in the dark, so as not to disturb other sleeping individuals.

Still yet another disadvantage of past night lights is that they do not take advantage of the aesthetically pleasing design of modern bathroom sinks, which often have acrylic or other multi-faceted light-transmissive and light-reflective handles. These handles can be difficult to see using past night lights due to the limited reflectivity of the light-transmissive material.

The present invention contemplates an improved apparatus and method that overcomes the above-mentioned limitations and others.

SUMMARY OF INVENTION

In accordance with one embodiment of the present invention, a night light for use in conjunction with an associated plumbing fixture is disclosed. The plumbing fixture includes a spout and a handle for controlling a water flow from the spout. The night light includes an LED arrangement comprising at least one LED disposed on or in the associated plumbing fixture for directly illuminating at least one of the handle, the water flow, and an associated basin.

In accordance with another embodiment of the present invention, a plumbing fixture is disclosed, including a showerhead or a faucet. The showerhead or faucet includes a water outlet for emitting a water flow and a handle for controlling the water flow. At least one LED is arranged on or in the showerhead or faucet and viewable by an associated user of the plumbing fixture. A light-transmissive encapsulant seals the LED and transmits light produced by the LED to the associated user. A controller produces a controller output for controlling the LED light emission responsive to at least one of a water flow rate, a water flow temperature, an ambient light level, and a position of the handle.

In accordance with yet another embodiment of the present invention, a lamp is disclosed. The lamp is adapted for arrangement on a faucet or showerhead including spout and at least one handle for controlling a water flow out of the spout. The lamp includes: a printed circuit board with conductive traces arranged thereon; an LED source including at least one LED arranged on the printed circuit board and electrically powered via the conductive traces; and a light-transmissive encapsulant sealing the LED source and the conductive traces.

One advantage of the present invention resides in illuminating a faucet or showerhead feature such as a handle to facilitate a night wandering person in locating the control.

Another advantage of the present invention resides in providing a low power, hermetically sealed light source for the safe illumination of water-producing fixtures.

Another advantage of the present invention resides in providing visual feedback relating to water stream parameters such as the flow rate or the water temperature.

Yet another advantage of the present invention resides in automatic activation of night illumination under low-light conditions.

Still yet another advantage of the present invention resides in convenient retrofitting of existing plumbing fixtures with lamps for providing night illumination, visual feedback information, or aesthetic value.

Numerous advantages and benefits of the present invention will become apparent to those of ordinary skill in the art upon reading and understanding the following detailed description.

BRIEF DESCRIPTION OF DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION

Figure 1:
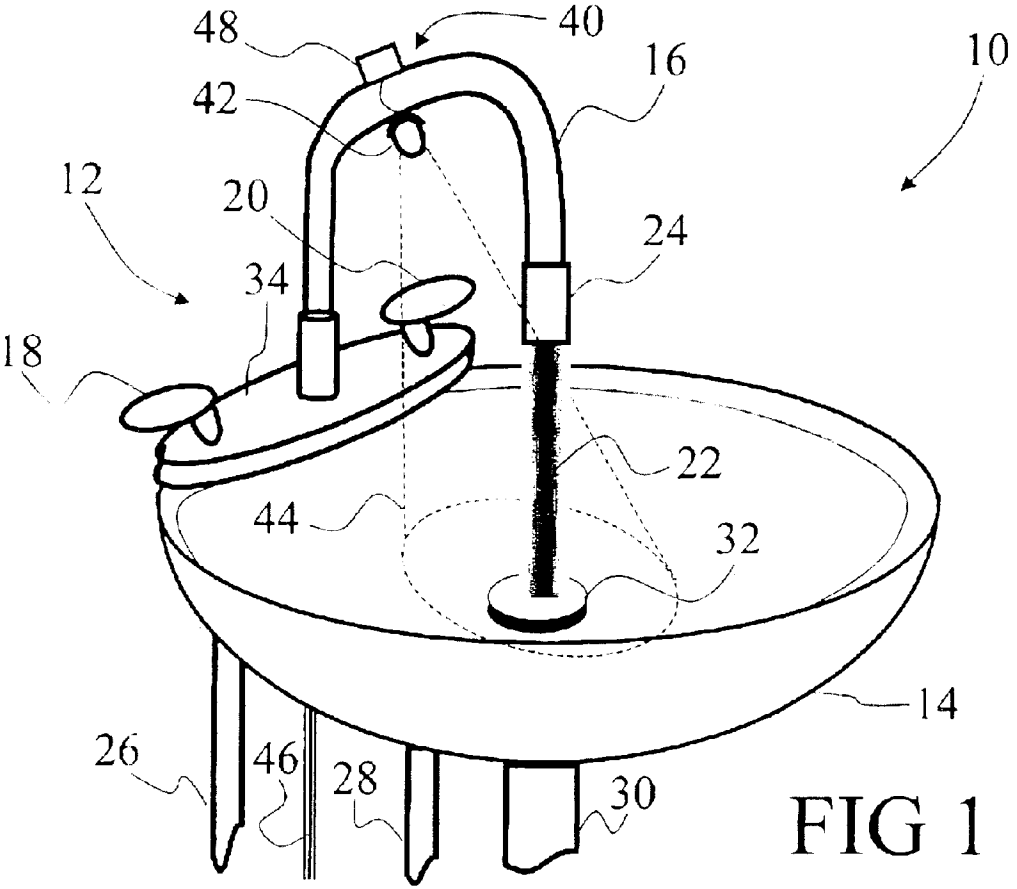
FIG. 1 shows an exemplary lavatory with a faucet that suitably practices an embodiment of the invention.

With reference to FIG. 1, a lavatory 10 has a faucet 12 and a washbasin 14. The faucet 12 includes a spout 16, a hot water handle 18, and a cold water handle 20. The spout 16 delivers an accessible flow of water 22 responsive to turning on one or both handles 18, 20. The person using the lavatory 10 can control the water temperature and flow rate in an open-loop fashion by adjusting the settings of the hot and cold water handles 18, 20 to suit individual preferences. An optional aerator 24 aerates the water flow 22 prior to expulsion from the spout 16 to provide improved flow uniformity. The faucet 12 is connected to hot and cold water supplies (not shown) through a hot water pipe 26 and a cold water pipe 28, respectively. A drain 30 connects the basin 14 to a sewer or other water removal system (not shown). A strainer, stop 32 or other interface is optionally included at the entrance to the drain 30. The handles 18, 20 can employ compression valves, cartridge valves, or other valving mechanisms (not shown).

The lavatory 10 is exemplary only, and many variations thereof can be while remaining within the scope of the invention. For example, the two-control faucet 12 having two handles 18, 20 can be replaced by a single-control faucet (e.g., FIG. 6) employing cartridge, ball, or disk-type washerless valves. Similarly, the illustrated embodiment shows a faucet 12 having a single raised base or deck 34, which however could be replaced by a concealed deck or a widespread faucet design having separate mountings for the spout and the handles. The aesthetic aspects of the lavatory 10 are also broadly variable. For example, there are a wide range of decorative spout designs commercially available. The invention embodiments described herein are readily adaptable to conform with all such variations. The invention embodiments are also readily adaptable to other types of bathroom plumbing fixtures such as showerheads (e.g., FIG. 9), and are furthermore readily adaptable to other types of fluid flow fixtures beyond the bathroom.

With continuing reference to FIG. 1, in one suitable embodiment of the invention, a night light 40 includes a light emitting diode (LED) 42 advantageously arranged to produce illumination 44 directed downward into the basin 14. In one preferred embodiment, the LED 42 is a light emitting diode such as a phosphide-based red light emitting diode, a blue or blue/green nitride-based light emitting diode, a phosphor-coated UV light emitting diode that emits white or other colored light, or the like.

Those skilled in the art will recognize that such light emitting diodes are low voltage, low current devices with typical operating voltages of a few volts and typical operating currents of a few tens or hundreds of milliamperes. Thus, the safety concerns that exist regarding the arrangement of prior art incandescent or fluorescent lamp-based night lights in close vicinity to an accessible flow of water are alleviated. The LED 42 is powered by an electrical cable 46 connected to an electrical power supply (not shown). In a suitable embodiment, the power supply is a 120 volt a.c. house electricity in conjunction with an a.c./d.c. converter known to the art or other electrical circuit for reducing the supplied power to conform to the low voltage, direct low current power requirements of the LED 42. It will be appreciated that the power conversion circuitry can be located well away from the lavatory 10, e.g. at the wall power socket, to ensure the safety of the night light 40 by admitting only low voltage, low current controlled and limited power to the lavatory 10 via the cable 46. Alternatively or in combination, a ground-fault-interrupt (GFI)

protected AC outlet or other protected power source is employed to reduce the electrical shock hazard.

In one suitable embodiment, a class 11 power supply disposed away from the lavatory 10 is used to drive the LED 42. As is known to those skilled in the art, the low voltage output of a class 11 power supply meets relevant electrical code requirements for use in the vicinity of the lavatory 10, and is also sufficient to drive a typical LED operating at a few volts and a few tens of milliamperes, e.g. 90 milliamperes. Alternatively, the circuitry can be located on or near the lavatory 10 in a hermetically sealed containment to minimize the electrical shock hazard.

In yet another suitable embodiment one or more dry-cell batteries are used. The batteries are suitably arranged in a battery pack located under or near the lavatory to provide easy access for battery replacement. It is also contemplated to use an inductively rechargeable battery such as are frequently employed in cardiac pacemakers. Since the inductively rechargeable battery does not need to be physically accessible for recharging, such a battery can be arranged inside the faucet or in other relatively inaccessible places.

With continuing reference to FIG. 1, the safety and low power consumption inherent in the low voltage, low current LED 42 makes it feasible to operate the night light 40 continuously. However, in the illustrated embodiment, an ambient light sensor 48, such as a photodiode known to the art, is included to control the operation of the night light 40. The sensor 48 produces a signal related to the intensity of the ambient light. In one preferred embodiment, the LED 42 is activated only when the sensor 48 indicates that the ambient light is below a selected threshold intensity.

Figure 2:
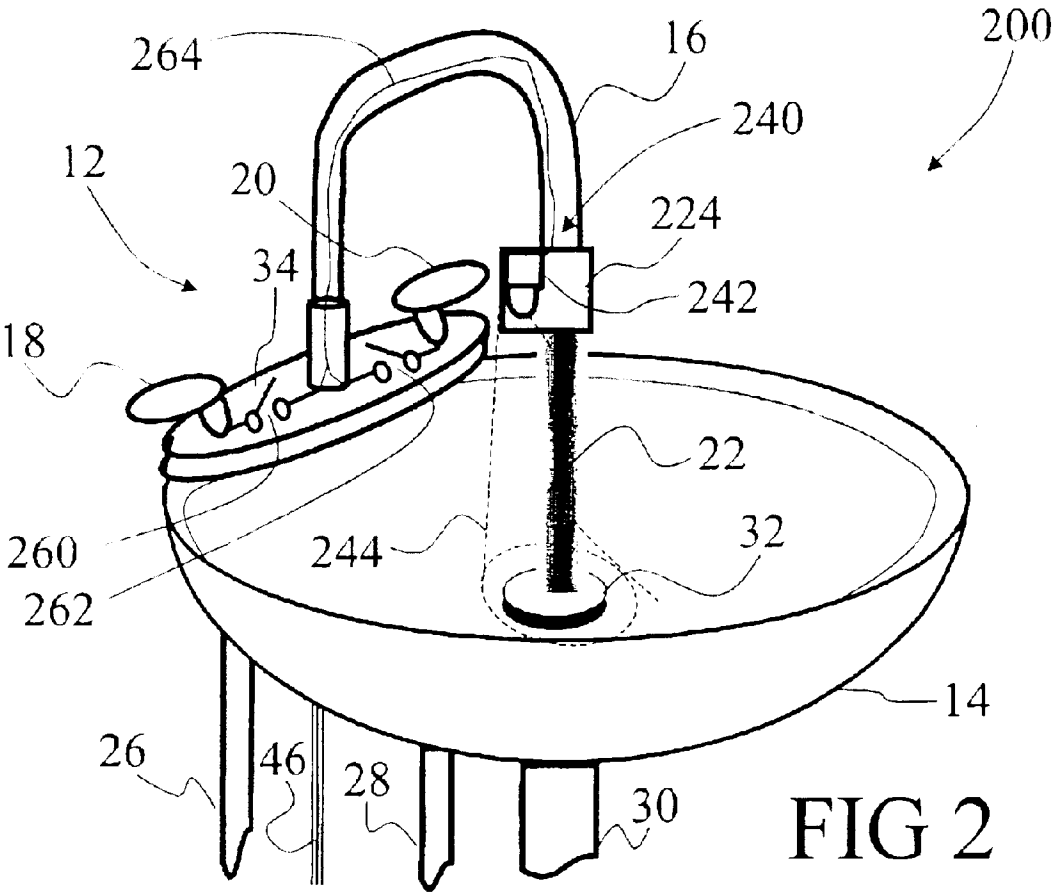
FIG. 2 shows an exemplary lavatory with a faucet that suitably practices another embodiment of the invention.

FIG. 2 shows another suitable lavatory embodiment 200, in which a night light 240 includes a light emitting diode (LED) 242 arranged inside a modified aerator 224. The night light 240 preferably uses a hermetically sealed light emitting diode for the LED 242, so that it is impervious to the flow of water. Furthermore, because the LED 242 is a low voltage, low current device, there is no danger of electrical shock to the person using the lavatory 200, even in the unlikely event of a failure of the hermetic sealing. Moreover, the extremely high reliability of hermetically sealed light emitting diodes compared with the much higher failure rates of incandescent or even fluorescent lamps ensures that the LED 242 will rarely if ever need to be replaced. In one contemplated embodiment, the aerator 224 and the LED 242 are manufactured as a single unitary component which is replaceable.

Because the LED 242 is actually contacting the water flow 22, emitted light 244 is partially wave guided along the water stream 22 to provide direct illumination of the stream 22. This is particularly advantageous because the person using the lavatory 200 is usually interacting directly with the water flow 22. This arrangement creates the visual effect that the water stream 22 itself is glowing with light, i.e. the water 22 appears to be the light source.

With continuing reference to FIG. 2, the LED 242 is a low power device which is suitable for continuous operation. However, in the embodiment shown, a pair of switches 260, 262 (shown schematically) are linked to the hot and cold water handles 18, 20, respectively. The switches 260, 262 connect the LED 242 to a power supply (not shown) through an electrical cable 264 running alongside or inside the spout 16, and activate the LED 242 in response to opening of one or both of the handles 18, 20. In addition to advantageously conserving electrical power, in this arrangement LED 242 turns on and off in response to the flowing or lack of flow of the water stream 22. This further adds to the aesthetic appeal by making it appear that it is the water stream 22 itself that is illuminated, or colored in the case of a colored LED 242, since the illuminating only appears coincident with a water flow 22.

In the illustrated embodiment of FIG. 2, on/off switches are shown, so that the illumination of the LED 242 appears fully on as soon as one of the handles 18, 20 are opened. In another contemplated embodiment (not shown), the handles operate a variable resistance or other current controller which controls the amount of current applied to the LED 242. In this manner the illuminating intensity depends upon the water flow 22 rate. In yet another variation (not shown), the LED 242 is replaced by two LEDs, one blue and one red. The blue LED is connected to the cold water handle while the red LED is connected to the hot water handle. In this manner, the water flow source (hot water or cold water) is indicated by the color of the water stream.

Figure 3:
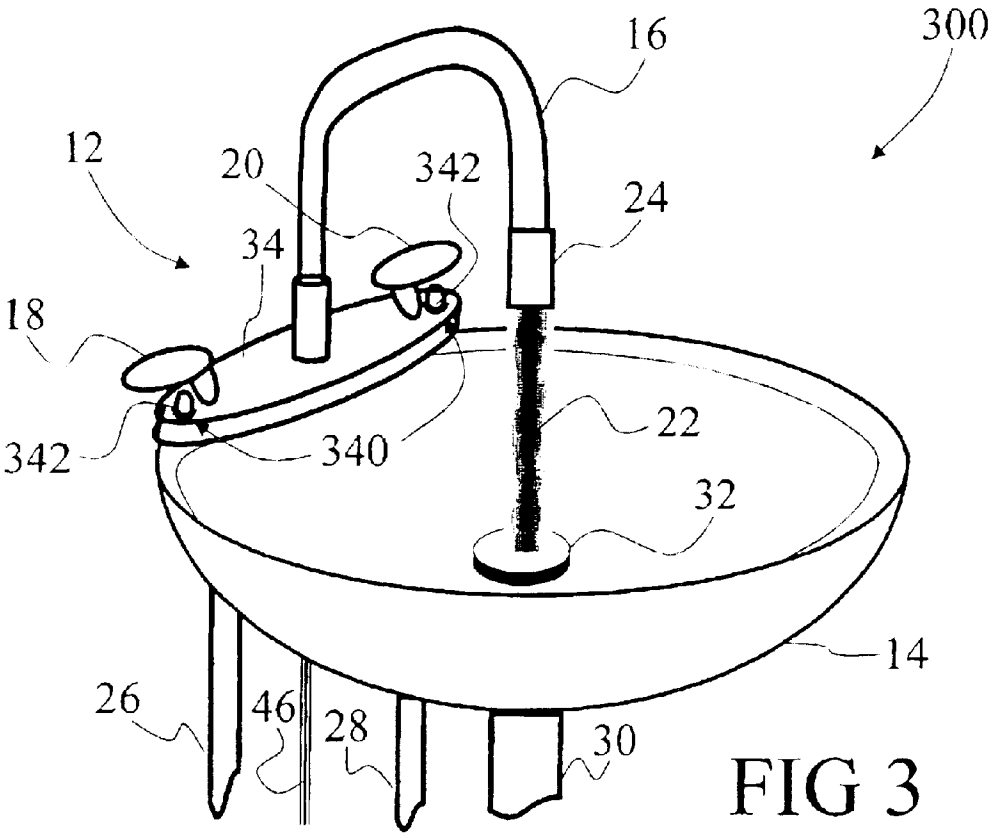
FIG. 3 shows an exemplary lavatory with a faucet that suitably practices yet another embodiment of the invention.

FIG. 3 shows another suitable lavatory embodiment 300, in which a night light 340 includes two light emitting devices (LEDs) 342, one each associated with the hot and cold water handles 18, 20. The night light 340 advantageously illuminates the handles 18, 20 which are the tactile target of a night-wandering person who wants to use the lavatory 300. In this embodiment, the LEDs 342 are advantageously low power light emitting diodes that are operated continuously, such continuous operation being appropriate because the LEDs 342 illuminate only the handles 18, 20, and therefore can be very low power devices. In an alternative embodiment (not shown), a light sensor such as the ambient light sensor 48 of FIG. 1 is employed so as to activate the night light 340 only at night.

Figure 4:
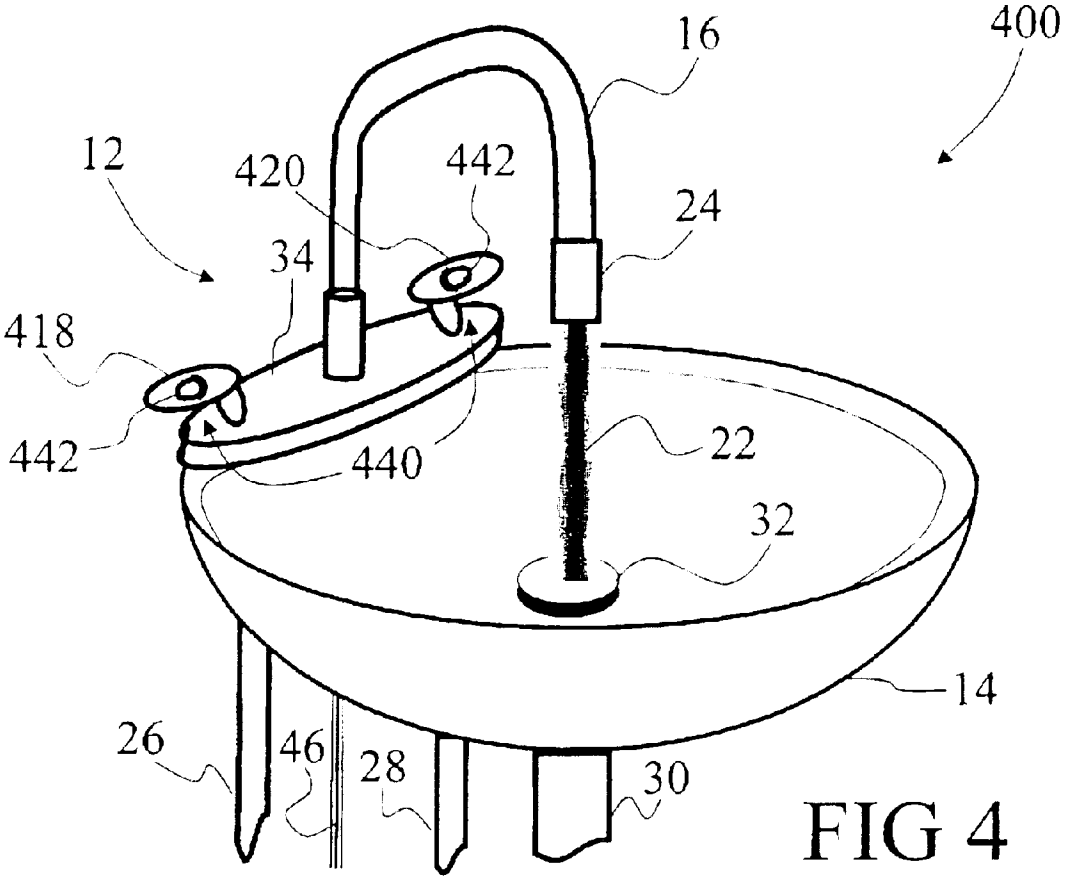
FIG. 4 shows an exemplary lavatory with a faucet that suitably practices still yet another embodiment of the invention.

With reference to FIG. 4, another suitable lavatory embodiment 400 is shown. A night light 440 is essentially similar to the night light 340 of FIG. 3, except that here two light emitting devices (LEDs) 442, which are again preferably light emitting diodes, are arranged within light transmissive handles 418, 420 which are translucent or transparent. It will be appreciated that such an arrangement is possible because light emitting diodes can be manufactured as small, low power devices which radiate relatively little heat as compared with incandescent lamps. In one preferred embodiment, the handles 418, 420 are replaceable components to facilitate replacement of the LEDs 442 in the unlikely event that an LED fails. It will be appreciated that the handles 418, 420 are advantageously molded using a light transmissive material such as an acrylic resin to provide hermetic sealing of the LEDs 442.

Figure 5:
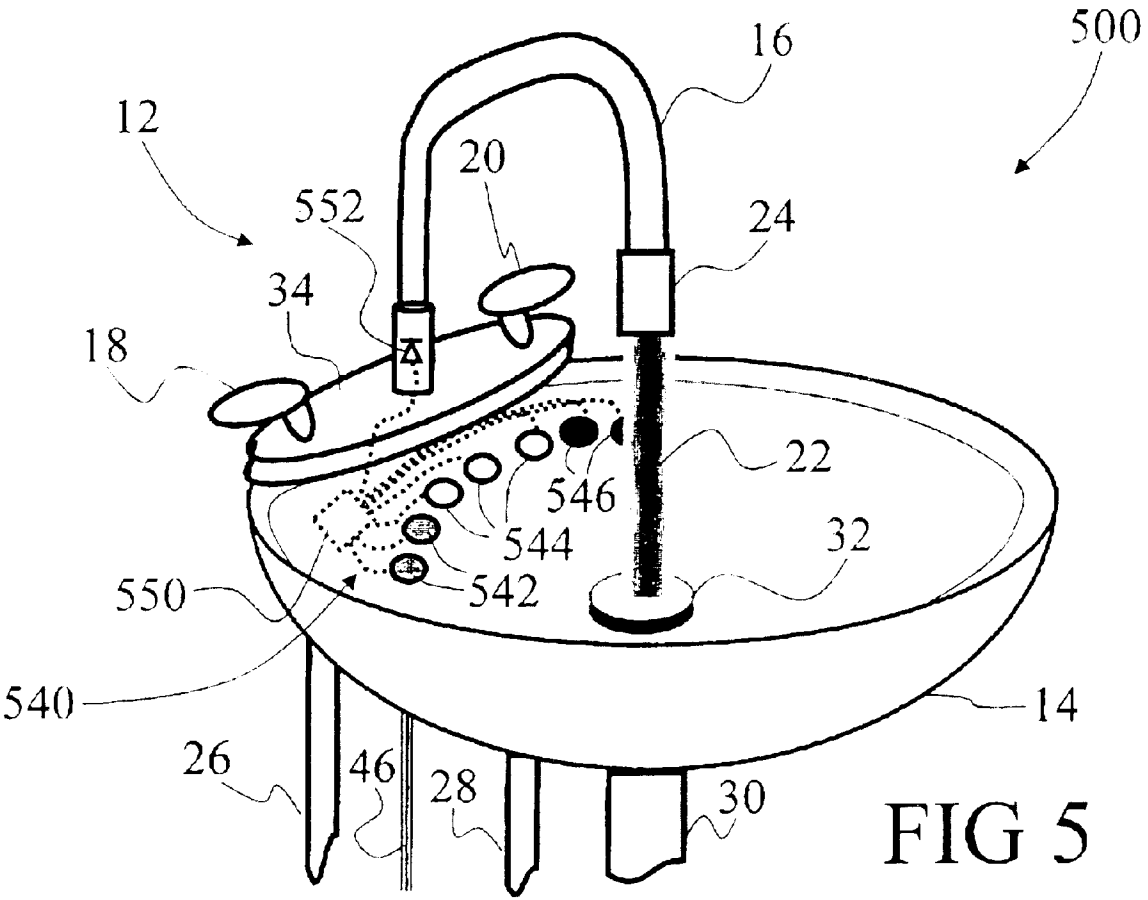
FIG. 5 shows an exemplary lavatory that suitably practices an embodiment of the invention wherein the night light provides both illumination and a visual indication of the operative status of the lavatory.

With reference to FIG. 5, yet another suitable lavatory embodiment 500 is shown, in which a night light 540 provides a visual indication of the temperature of the water flow 22. The night light 540 includes two LEDs 542 of a first class, three LEDs 544 of a second class, and two LEDs 546 of a third class. In one suitable embodiment, the LEDs 542 of the first class are blue nitride-based light emitting diodes, the LEDs 544 of the second class are white phosphor-coated nitride-based light emitting diodes, and the LEDs 546 of the third class are red phosphide-based light emitting diodes. Of course other numbers and/or colors of LEDs can be employed.

With continuing reference to FIG. 5, the LEDs 542, 544, 546 are selectively operated by a controller 550, which includes control circuitry typically embodied as an integrated circuit. In one suitable embodiment, the controller 550 includes an application-specific integrated circuit (ASIC) specifically designed for use in the night light 540. The controller 550 receives a signal corresponding to a temperature of the water flow 22 from a temperature sensor 552, which in a suitable embodiment is a temperature-sensitive resistor in thermal contact with the spout 16. In a suitable embodiment, the sensor 552 contacts the spout 16 but does not directly contact the water flow 22, so that the temperature is indirectly measured. This indirect temperature measurement arrangement is suitable for spouts which are highly thermally conductive, such as metal spouts. In another suitable embodiment (not shown), the temperature sensor directly contacts the water flow 22. In either arrangement, the controller 550 activates one or more of the LEDs 542, 544, 546 based on the output of the temperature sensor.

In a suitable embodiment, the LEDs 542 are activated when the temperature is below a selected lower threshold, thus indicating a cold water flow by a blue illumination. The LEDs 544 are activated when the temperature is within a preferred temperature range extending from the lower threshold to a selected upper threshold, thus indicating by a white, green, or other selected illumination hue that the preferred temperature range is achieved. The LEDs 546 are activated when the temperature exceeds the upper threshold, thus indicating by a red illumination that the water is too hot. Red is a preferred color to indicate that the upper temperature threshold has been exceeded because red is typically associated danger, and an overly hot water flow can be a dangerous condition. Optionally, the controller 550 causes the LEDs 546 flash when the temperature exceeds a danger threshold greater than the upper threshold, to even more strongly indicate to the night wandering person that the water flow 22 is extremely hot.

It will be appreciated that the embodiment of FIG. 5 can, with minor modifications, be adapted to provide a visual indication of other operating parameters of a lavatory or other fluid flow fixture. For example, the temperature sensor 552 can be replaced by a flow meter which, along with appropriate changes to the control circuitry 550, forms a night light that is responsive to the water flow rate. Similarly, the temperature sensor 552 can be replaced by an appropriate chemical sensor and appropriate changes to the control circuitry 550 to form an illuminated indicator responsive to the presence or absence of a selected chemical in the flow, which flow can be a water flow or a flow of another type of fluid.

Figure 6:
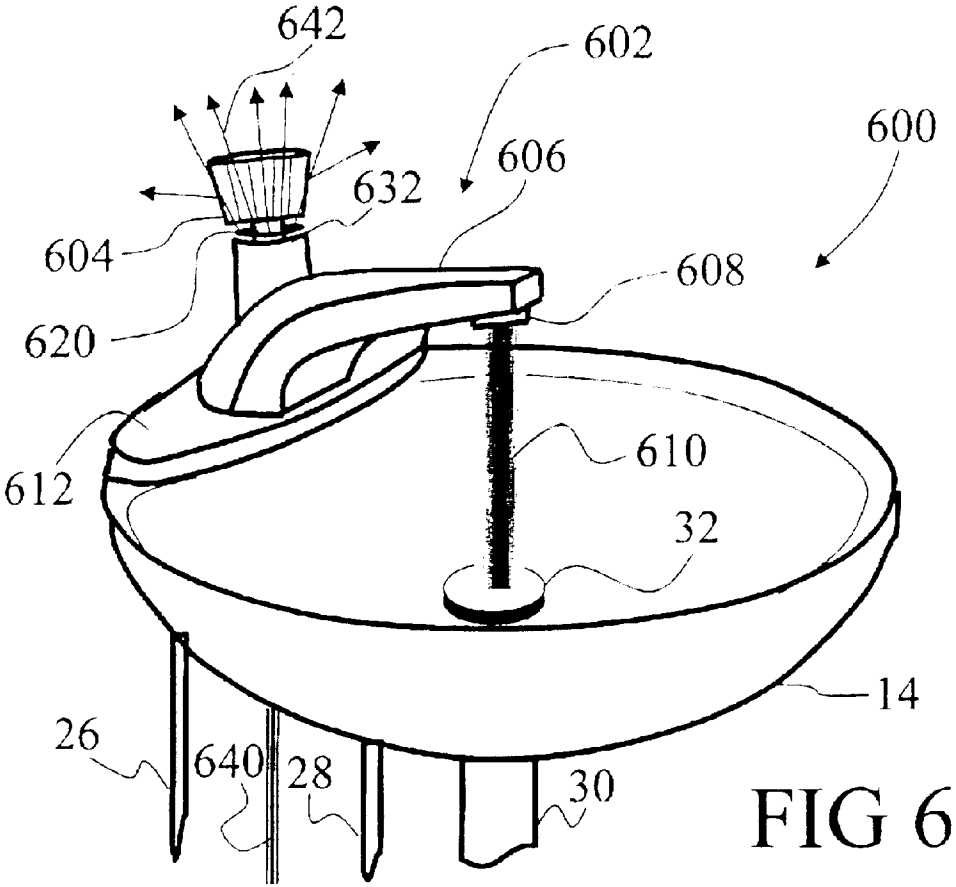
FIG. 6 shows an exemplary lavatory with a centrally located single-handle faucet that suitably practices an embodiment of the invention.

With reference to FIG. 6, an embodiment 600 of the invention incorporating a centrally-located single-handle faucet 602 is described. Such faucets are well known to the art, and typically are operated by pulling a handle knob 604 upward or away from the faucet 602 to turn on the water, and by rotating the knob 604 to selectively mix the hot and cold water supplies. In one common embodiment, the knob 604 is manufactured of an acrylic resin or other light-transmissive material, often with aesthetically pleasing facets for light reflection and light scattering. The faucet 602 also includes an aesthetically pleasing contoured spout 606 terminating in an aerator 608 for producing a water flow 610, and the faucet is mounted on a base 612. Instead of the base 612, the faucet 602 could be mounted on a concealed deck (not shown). The faucet 602 operates in conjunction with a washbasin 14 and associated piping 26, 28, 30 and strainer or stop 32 which are essentially as described previously with respect to FIG. 1.

Figure 7:
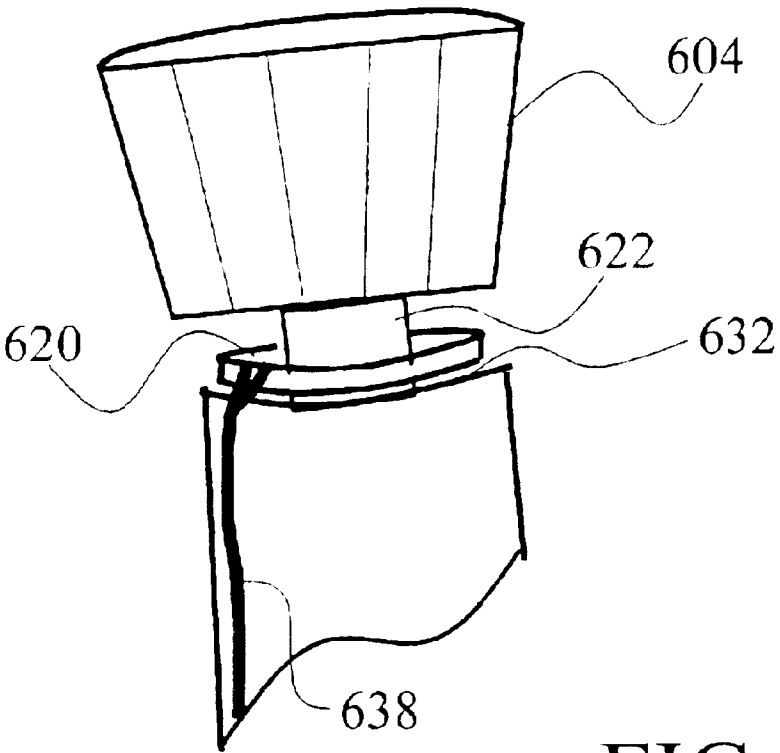
FIG. 7 shows a close up of the handle of the lavatory of FIG. 6 with the night light arranged thereon.
Figure 8:
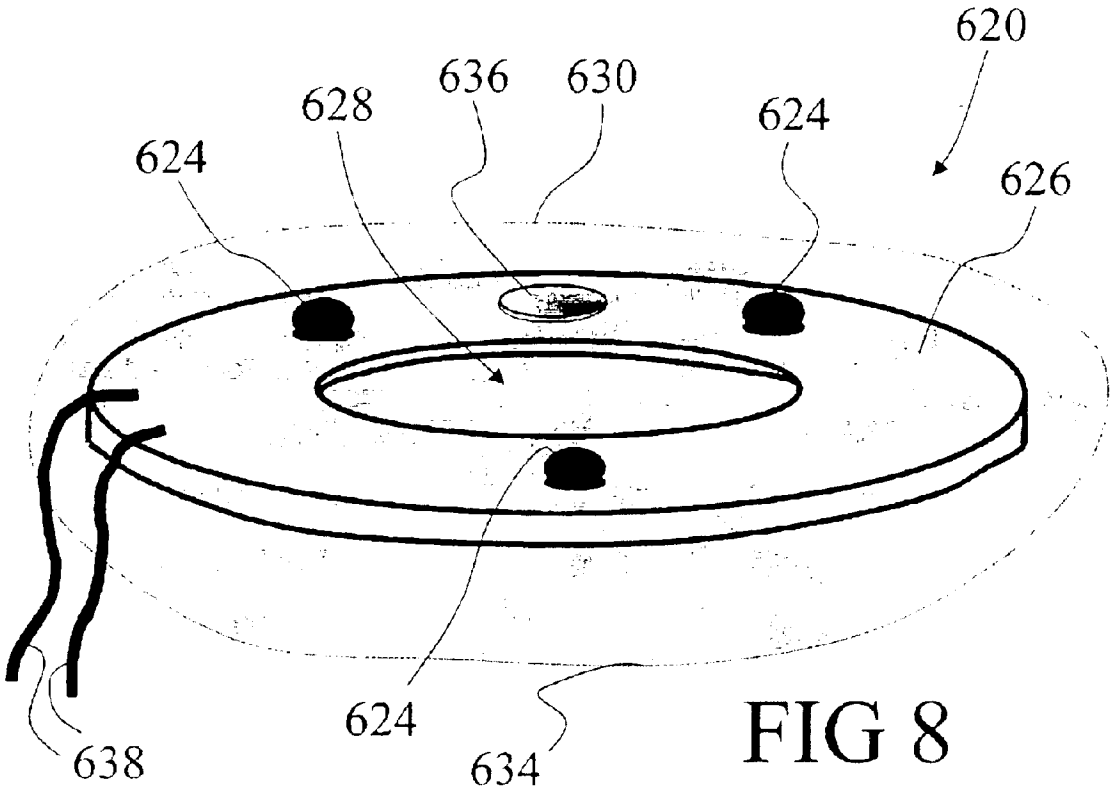
FIG. 8 shows an enlarged view of the night light of FIGS. 6 and 7.

With continuing reference to FIG. 6 and with further reference to FIGS. 7 and 8, a night light 620 is mounted on a handle shaft 622 on which the handle knob 604 is disposed. The night light 620 includes a plurality of LED's 624 arranged on a printed circuit (pc) board 626 shaped into an annular disk having a central opening 628 which receives the handle shaft 622. The annular disk-shaped pc board 626 and the LEDs 624 disposed thereon are sealed by an encapsulant 630 to prevent damage to the electronics by water exposure. In a suitable embodiment, the encapsulant 630 is formed in a mold which conforms with a recess, surface, or feature 632 of the handle of the faucet 602 so that a surface 634 of the encapsulant 630 matingly fits into or onto the surface or feature 632. The manufacturing of the night light 620 can be adapted to produce night lights compatible with a wide range of styles and designs of faucets by employing different suitable molds. It will further be appreciated that the night light 620 is particularly suitable for retrofitting into existing single-handle faucets of various designs and styles.

The pc board 626 includes conductive traces (not shown) which interconnect the LEDs 624 and optional associated control elements such as a light sensor 636 to define electrical power and control circuitry for driving the LEDs 624. Preferably, any associated elements such as the light sensor 636, ASIC control and/or power circuitry (not shown) and the like are also sealed by the encapsulant 630 to form a hermetically sealed, waterproof unitary night light 620. Power leads 638 pass through the encapsulant 630 and provide electrical power to the pc board 626. The leads 638 connect to an electrical line 640 leading to a class 11 power supply (not shown). Alternatively, a battery pack or other type of power supply is used.

With continuing reference to FIGS. 6–8, the light sensor 636 detects the ambient light level. Responsive to the ambient light level decreasing below a selected turn-on light level criterion, the circuitry on the pc board 626 activates the LEDs 624 to produce light output 642 (indicated schematically by arrows in FIG. 6) which is directed into the light transmissive knob 604. The light 642 passes through the light-transmissive knob 604 and is also significantly scattered by the knob 604. The knob 604 "glows" with the light 642, providing illumination for the night-wandering person and making it particularly easy for such a person to locate the knob 604 in the dark.

With the arrangement shown in FIG. 8, wherein the light sensor 636 and the LEDs 624 are in close relative proximity (i.e., within range of optical communication), the spectral responsivity of the light sensor 636 is advantageously selected to be outside the spectral range of the LED light output 642. This spectral separation reduces the possibility of undesirable interactions such as the light 642 of the LEDs 624 causing the light sensor 636 to shut off the LEDs 624. Of course, the 630 should also be light-transmissive for the spectral range monitored by the light sensor 636, and the spectral range monitored by the light sensor 636 should fall well within the ambient spectrum. In a suitable embodiment, the LEDs 624 emit light in the visible spectrum and the light sensor 636 monitors the infra-red spectrum and includes a visible light blocking filter.

With proper selection of relative spectral ranges, the light sensor 636 is suitably mounted on the pc board 626. This arrangement is particularly convenient for electrical interconnection as the pc board 626 suitably includes conductive traces effectuating the interconnections. However, if a sensor other than an ambient light sensor is desired, such as a water temperature or flow sensor (not shown), the sensor is preferably located remotely from the pc board 626 where it can effectively monitor the desired parameter. In such a case, leads (not shown) additional to the power leads 638 are included to connect the remote sensor with the pc board 626. In another contemplated variation, the LEDs 624 include a plurality of colors, and combined with appropriate circuitry on the pc board 626 and a temperature sensor (not shown) implement a color indicator of temperature operatively similar to that of FIG. 5.

Figure 9:
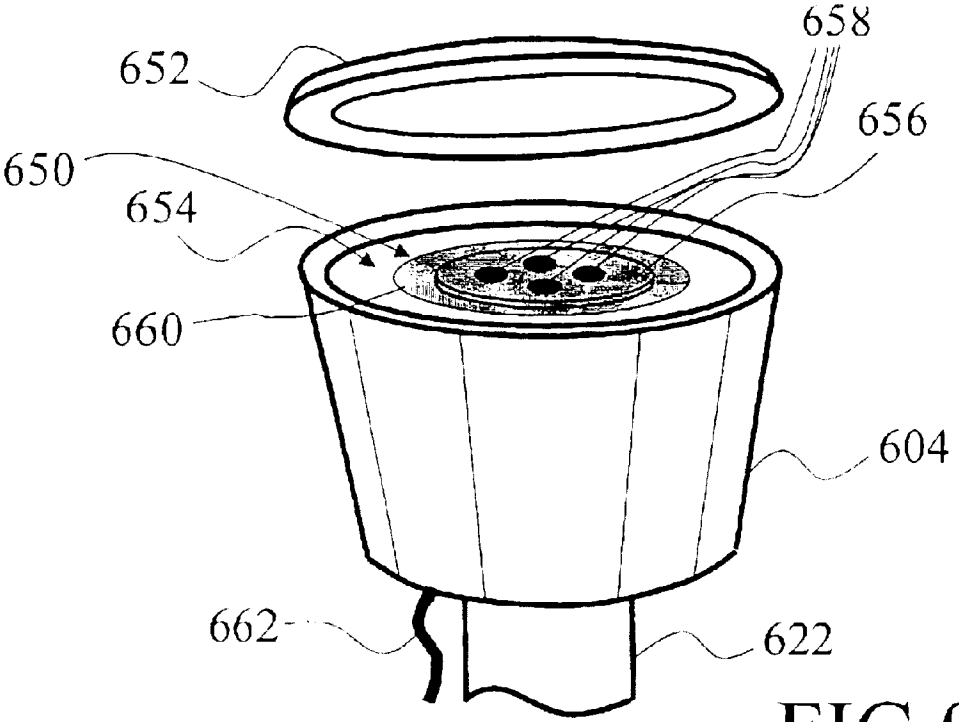
FIG. 9 shows another embodiment of a handle-based night light for a single-handle faucet.

With reference to FIG. 9, another embodiment of a night light 650 suitable for use with a single-handle faucet similar to that of FIG. 6 is shown. As is known to those skilled in the art, the knob 604 is typically connected with the shaft 622 by a threaded fastener which is accessed through a removable top portion 652 of the knob 604. In such arrangements there is often an interior open volume 654 inside the 604 which is unused once the knob is affixed to the shaft 622. As seen in FIG. 9, the night light 650 is suitably arranged in the open volume 654. The night light 650 includes a disk-shaped pc board 656 with one or more LEDs, e.g. four LEDs 658 in FIG. 9, arranged thereon. The pc board 656 and the LEDs 658 are hermetically sealed by an encapsulant 660 which is advantageously formed using a mold to substantially conform with the open volume 654. Electrical leads 662 are suitably passed through an opening (not shown) in the knob 604.

The night light 650 is suitable for retro-fitting existing single-handle faucets. However, the retrofitting of the night light 650 typically requires modifying the knob 604 by drilling or otherwise generating the opening for the leads 662. Although not shown in FIG. 9, it will be appreciated that a light sensor or other controller elements are suitably included on the pc board 656 to provide selective illumination responsive to low ambient light or other conditions.

Figure 10:
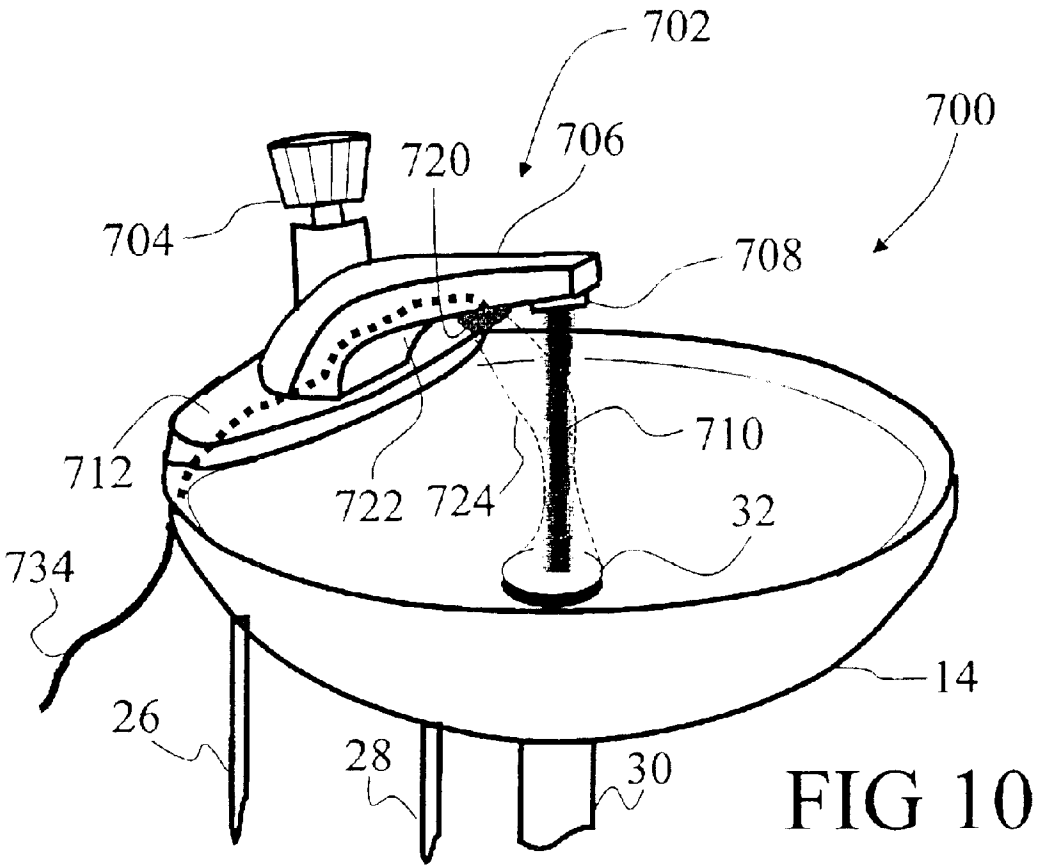
FIG. 10 shows another embodiment of a single-handle lavatory including a night light in formed in accordance with yet another embodiment of the invention.

With reference to FIG. 10, an embodiment 700 incorporating a centrally-located single-handle faucet 702 is described. The faucet 702 is operated by pulling a handle knob 704 upward or away from the faucet 702 to turn on the water, and by rotating the knob 704 to selectively mix the hot and cold water supplies. The faucet 702 also includes a spout 706 terminating in an aerator 708 for producing a water flow 710, and the faucet is mounted on a base 712. Instead of the base 712, the faucet 702 could be mounted on a concealed deck (not shown). The faucet 702 operates in conjunction with a washbasin 14 and associated piping 26, 28, 30 and strainer or stop 32 which are essentially as described previously with respect to FIG. 1. The faucet 702 also includes a lamp 720 mounted on a detachable lower cover plate 722 of the spout 706. As is known to those skilled in the art, many commercial faucets include a detachable lower plate to provide convenient access to the internal plumbing and valving of the faucet. The lamp 720 includes one or more LEDs and optional optics (not shown) to direct light 724 toward the water flow 710.

The light 724 is partially wave guided by the water stream 710 to illuminate the water flow 710. Optionally, the lamp 720 includes a water flow sensor for selectively activating the LEDs responsive to initiation of water flow.

Figure 11:
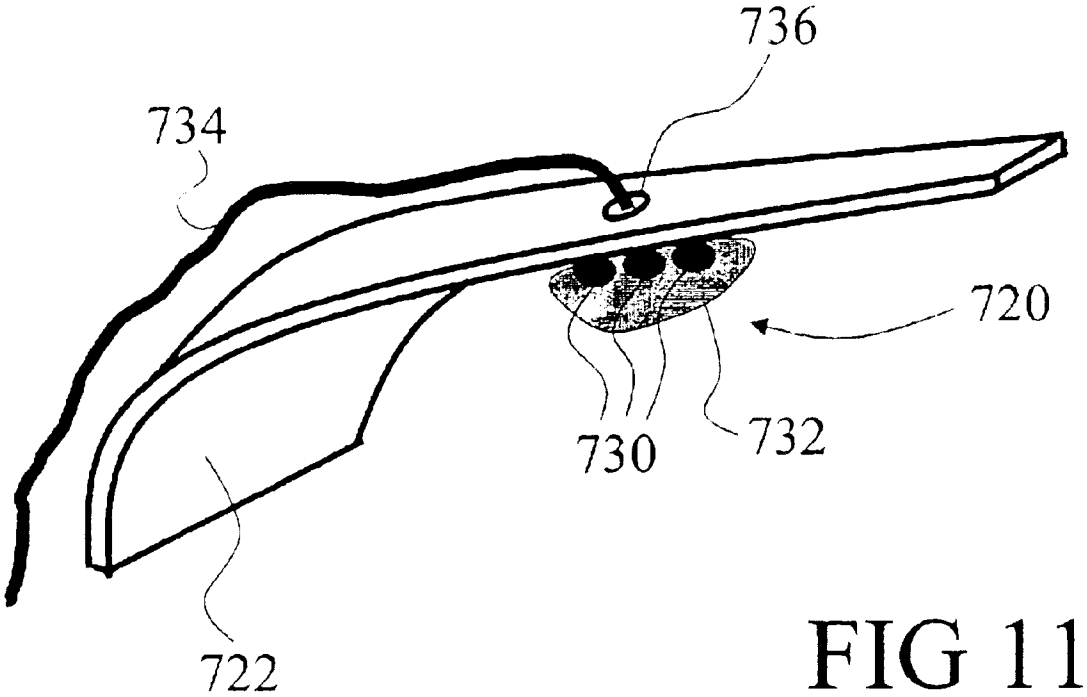
FIG. 11 shows an enlarged view of the modified bottom faucet cover plate of FIG. 10.

With continuing reference to FIG. 10 and with further reference to FIG. 11, the lamp 720 is suitable for retrofitting existing faucets. In a suitable retro-fit, the cover plate 722 is a replacement cover plate which includes LEDs 730 mounted thereon and which replaces the original lower detachable cover plate of the spout 706. Optionally, associated optics such as lenses or filters (not shown) are also included to direct light produced by the LEDs 730 onto the water stream 710. Because the lamp 720 is located underneath the spout 706, it is likely to be exposed to water, soap, or other contaminants. Hence, the lamp 720 is sealed in an encapsulant 732. A pc board (not shown) can be used in constructing the lamp 720, in a manner similar to the embodiments 620, 650 described previously. However, because of aesthetic concerns in having an exposed pc board on the spout, coupled with the design freedom provided by the detachable cover plate 722, in the illustrated embodiment no pc board is employed in mounting the LEDs 730.

Electrical connecting of the lamp 720 is particularly convenient because, as is well known to those skilled in the art, many centrally located single-handle faucets include a continuous open volume extending through significant portions of the spout and the handle region and accessible from the base 712. Hence, as shown in FIGS. 10 and 11, an electrical cord 734 connects with the LEDs 730 via an opening 736 in the cover plate 722, runs through the open volume of the faucet 702 (this portion of the cord is shown as a dotted line in FIG. 10) and is accessible below or behind the lavatory 700. In this manner, the lamp 720 presents an aesthetically pleasing appearance without exposed wires.

Figure 12:
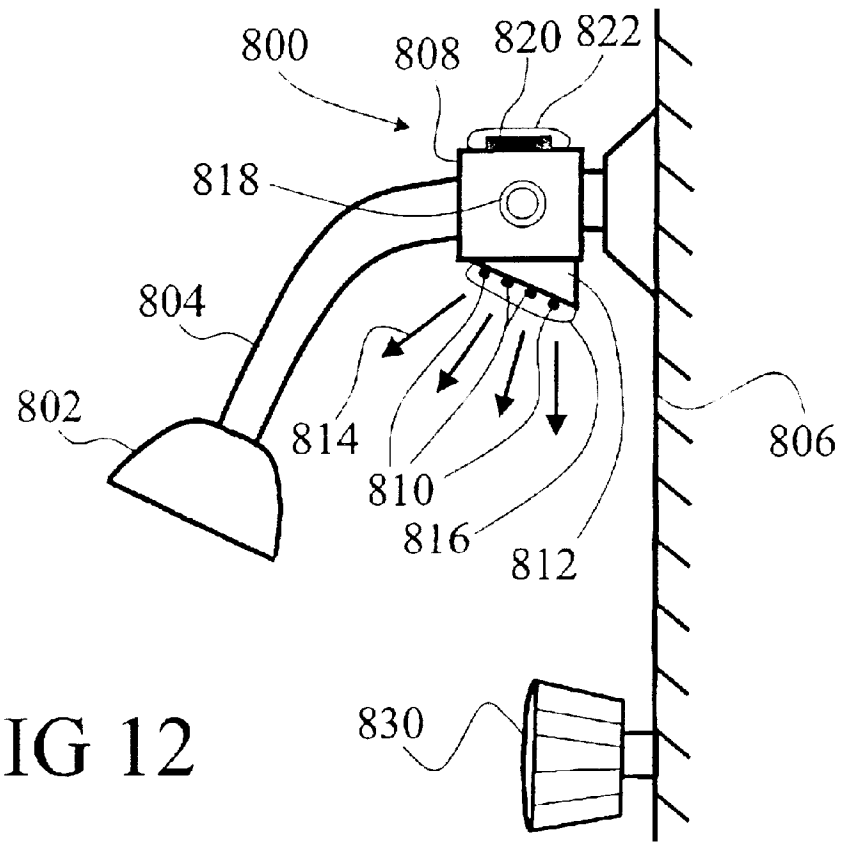
FIG. 12 shows a showerhead that suitably practices a detachably fastenable embodiment of the invention.

With reference to FIG. 12, a detachably attachable LED lamp 800 formed in accordance with the invention is described, for use with a showerhead 802 disposed on a distal end of a pipe or spout 804 connected to a shower wall 806. The lamp 800 clamps onto the spout 804 in detachable manner by a clamping collar 808. A plurality of LEDs 810 are arranged on a slanted bottom portion 812 of the collar 808 oriented so as to provide illumination 814 (schematically shown as arrows) into the shower. Due to the moist environment, the LEDs 810 are sealed in an encapsulant 816. The LEDs 810 are powered by a replaceable battery 818, such as a button-type dry cell commonly used in watches, via appropriate wiring for example provided by a pc board (not shown). Optionally, selected feedback control is provided. In the exemplary lamp 800, an ambient light sensor 820 is disposed on an opposite side of the collar 808 from the LEDs 810 for sensing ambient light conditions and activate the LEDs 810 under low light conditions. The ambient light sensor 820 is also preferably covered sealed by a light-transmissive encapsulant 822.

In another contemplated embodiment, a thermal sensor (not shown) is arranged on an inside surface of the collar 808 in thermal contact with the spout 804. In the case of a metal or other highly thermally conductive spout 804, the spout temperature closely follows the temperature of the water flowing therethrough, and so the thermal sensor can be used to control an aspect of the LED light output. For example, the LEDs 810 can include blue and red LEDs which light up variably as the water temperature increases from cold to hot, starting at mostly blue for cold water, and shifting toward mostly red for a high water temperature. This provides visual feedback regarding the water temperature which can be useful when preparing the shower water flow for use. If the water temperature exceeds a selected threshold, the red LEDs optionally flash to provide a warning indicator. Because the operator is often watching a control handle 830 for controlling water flow from the showerhead 802 during the preparation, it is also contemplated to arrange temperature-indicating blue, white, and red LEDs thereon. Of course, other colors besides the blue/white/red combination can also be employed.

Figure 13:
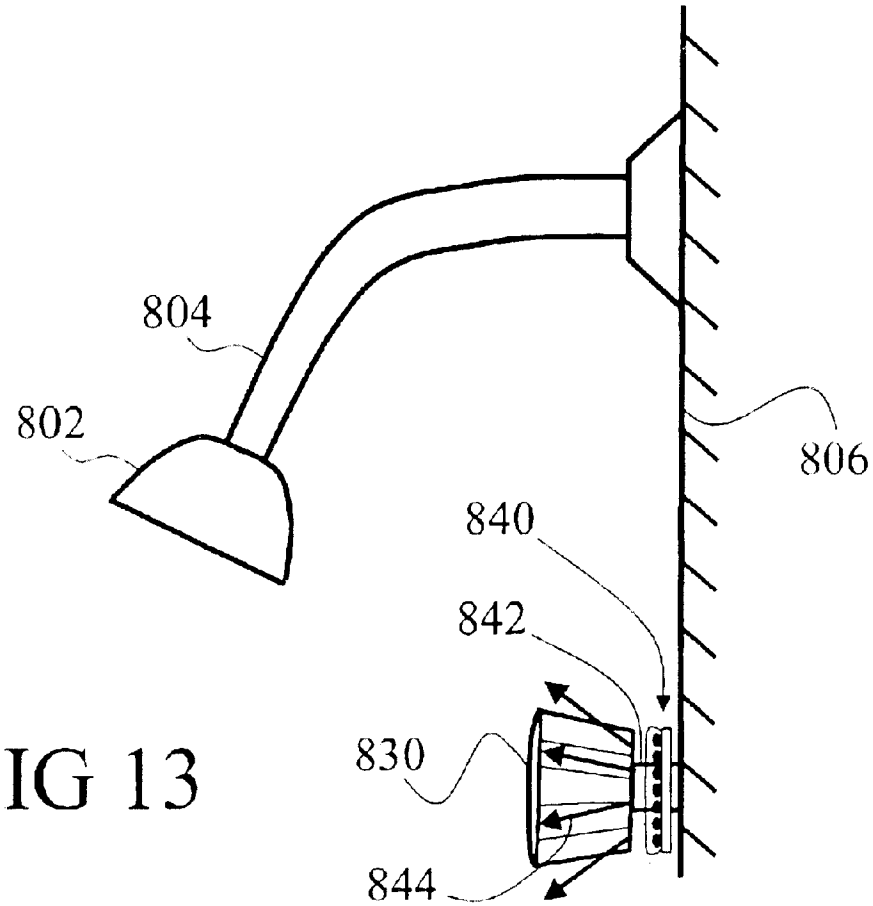
FIG. 13 shows a showerhead with an LED lamp arranged on a shaft of a water flow control handle.

With reference to FIG. 13, another shower LED lamp embodiment 840 is shown. The lamp 840 is located under the handle 830, mounted on a showerhead flow control handle shaft 842 on which the handle 830 is disposed. This mounting arrangement is similar to the mounting arrangement of the faucet handle night light 620 described with reference to FIG. 7. The faucet handle 830 is preferably light transmissive so that light 844 (schematically represented by arrows) produced by the LED lamp 840 transmits through the handle 830. The LED lamp 840 optionally includes an ambient light sensor, thermal sensor, or other controlling sensor element, a printed circuit board with controller circuitry arranged thereon, or like elements (not shown).

Figure 14:
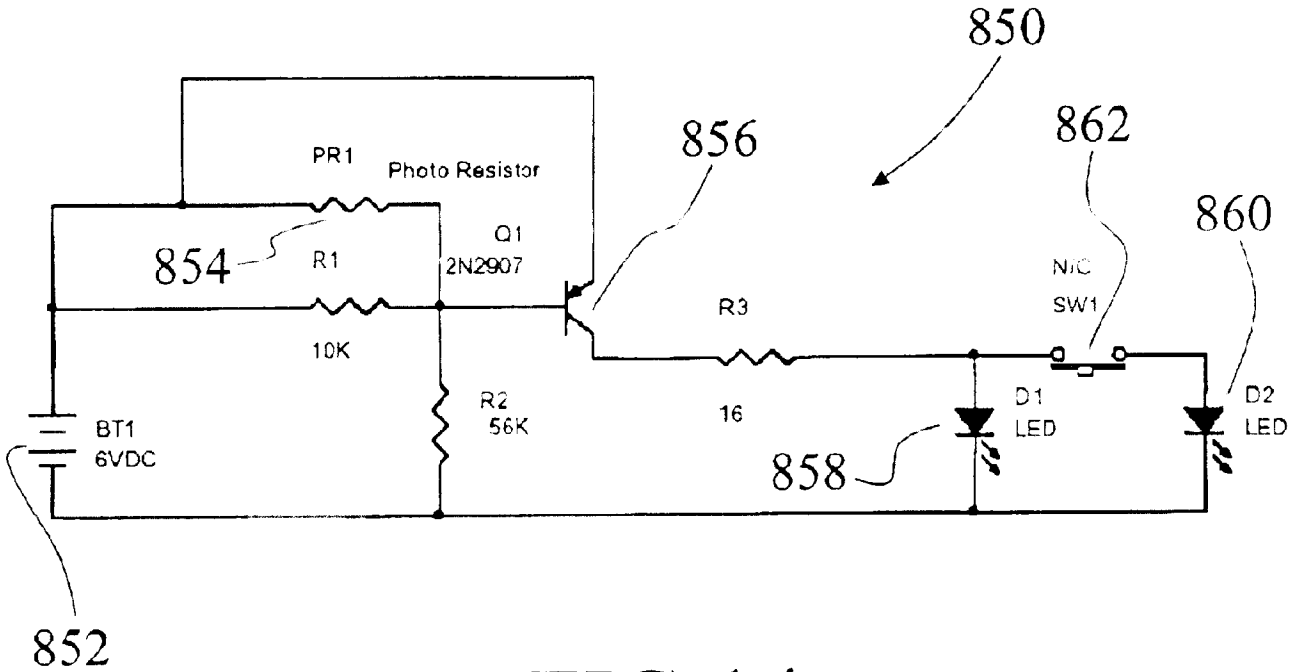
FIG. 14 shows an exemplary electrical circuit for controlling LEDs based on an ambient light intensity.

With reference to FIG. 14, a suitable electrical circuit 850 for controlling an LED used for a night light is described. The circuit 850 includes, among other circuit elements, a voltage source 852, a photoresistor 854, a transistor 856, and a first LED 858. Current flows in the channel of the transistor 856 responsive to light on the photoresistor 854 dropping below a selected intensity. The transistor current drives the first LED 858. Optionally, a second LED 860 is also energized responsive to operation of a manual switch 862. The circuit 850 is suitable, for example, to drive the night light 620 or the night light 650 of FIGS. 8 and 9, respectively, which provide night lighting responsive to a low light level. The circuit 850 is suitably embodied as circuitry arranged on the printed circuit board 626 of the night light 620 or on the printed circuit board 656 of the night light 650. The second LED 860 is suitably embodied by the LED lamp 720, shown in FIGS. 10 and 11, which illuminates the water stream 710.

Figure 15:
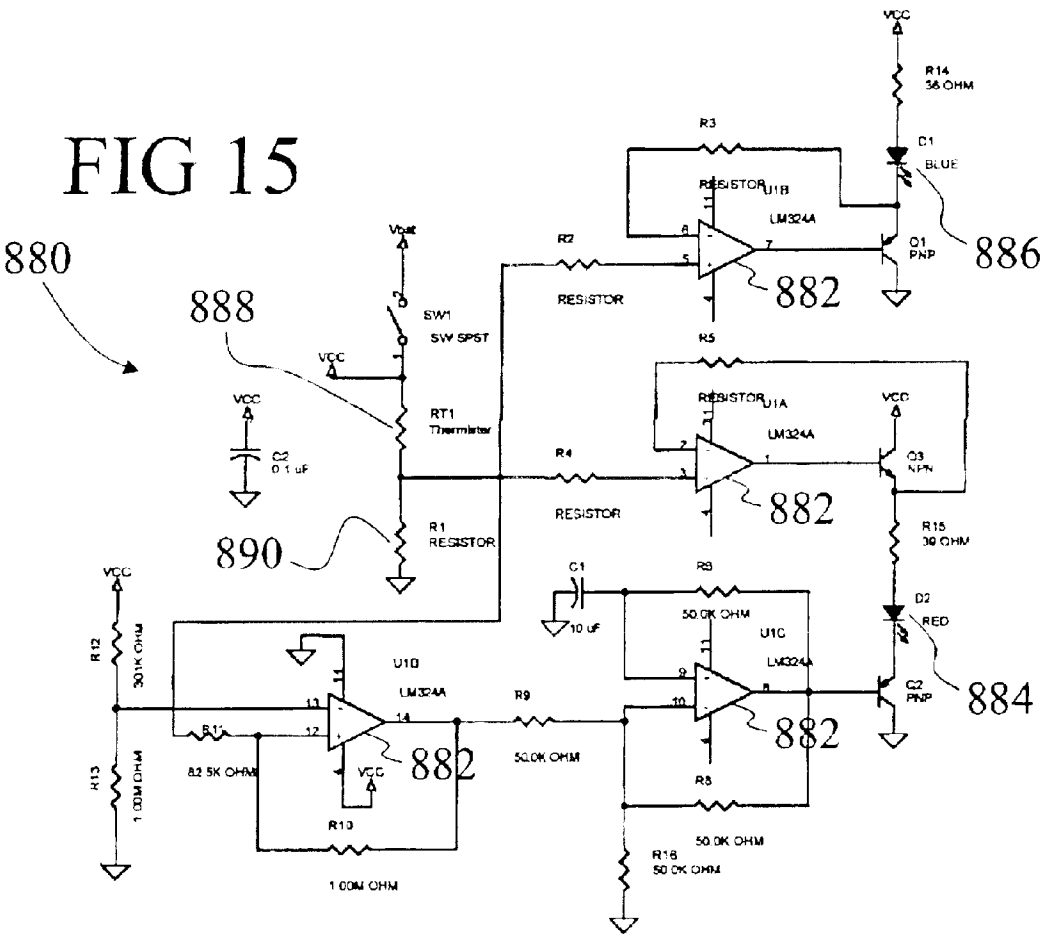
FIG. 15 shows an exemplary analog circuit for controlling a red and a blue LED responsive to a water flow temperature input.

With reference to FIG. 15, a suitable analog electronic circuit 880 includes a plurality of operational amplifiers (op amps) 882 cooperating with other circuit elements to control a red LED 884 and a blue LED 886 based on a water temperature input. A thermistor 888 in thermal contact with the water stream cooperates with a reference resistor 890 to provide a voltage reference indicative of the water temperature. The circuit 880 provides relatively stronger illumination from the red 884 and weaker illumination from the blue LED 886 responsive to a high temperature. At a predetermined high temperature threshold, the circuit 880 causes the red LED 884 to blink indicating an uncomfortably or dangerously high temperature. The circuit 880 provides relatively stronger illumination from the blue LED 886 and weaker illumination from the red LED 884 responsive to a cool temperature. The circuit 880 is suitable, for example, to drive the LED lamp 800 of FIG. 12 when using a thermal sensor, i.e. the thermistor 888.

Figure 16:
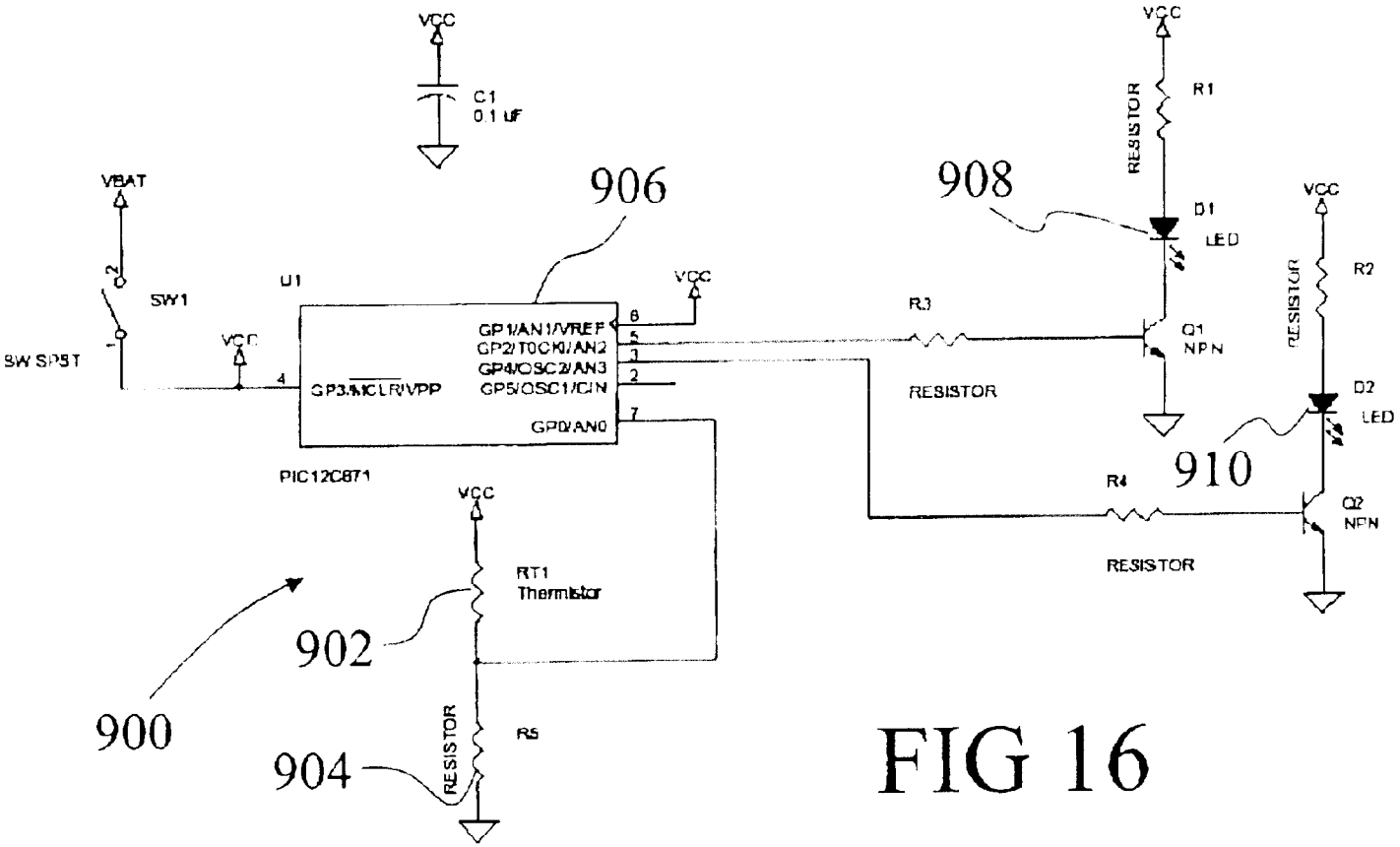
FIG. 16 shows an exemplary circuit for controlling a multi-color LED arrangement based on a water flow temperature input.

With reference to FIG. 16, yet another suitable electronic circuit 900 for controlling a multi-color LED combination based on a water temperature is shown. A thermistor 902 in thermal contact with the water stream cooperates with a reference resistor 904 to provide a voltage reference indicative of the water temperature. A microcontroller 906 cooperates with additional circuit elements to provide pulse width modulation (PWM) control of power input to a plurality of LEDs 908, 910 of selected colors. The microprocessor-based circuit 900 is suitable, for example, for use in the lavatory 500 shown in FIG. 5.

The circuits 850, 880, 900 of FIGS. 14–16 are exemplary only. Those skilled in the art can modify these circuits or provide other electrical arrangements that are suitable for specific applications and embodiments of the invention.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A night light for use in conjunction with an associated plumbing fixture including a spout and a handle for controlling a water flow from the spout, the night light comprising:

an LED arrangement comprising at least one LED disposed on or in the associated plumbing fixture for directly illuminating at least one of the handle, the water flow, and an associated basin; and a hermetic sealant that seals the LED arrangement against contact with water.

2. The night light as set forth in claim 1, wherein the plumbing fixture includes one of a faucet and a showerhead.

3. The night light as set forth in claim 1, further including:

a switch that electrically energizes the LED arrangement conditional upon a presence of a pre-selected flow of water from the spout.

4. The night light as set forth in claim 1, wherein the LED arrangement includes:

an LED disposed near the handle.

5. A night light for use in conjunction with an associated plumbing fixture including a spout and a handle for controlling a water flow from the snout, the night light comprising:

an LED arrangement comprising a first color LED that emits light having a first color, and a second color LED that emits light having a second color, disposed on or in the associated plumbing fixture for directly illuminating at least one of the handle, the water flow, and an associated basin.

6. The night light as set forth in claim 5, further including:

a temperature sensor for producing an output indicative of a temperature of the water flow, the temperature sensor modulating an intensity of the first color LED and an intensity of the second color LED responsive to the temperature of the water flow.

7. A night light for use in conjunction with an associated plumbing fixture including a spout and a handle for controlling a water flow from the spout, the night light comprising:

an LED arrangement comprising at least one LED disposed on the handle of the associated plumbing fixture for directly illuminating at least one of the handle, the water flow, and an associated basin.

8. A night light, for use in conjunction with an associated plumbing fixture including a spout and a handle for controlling a water flow from the spout, the night light comprising:

an LED arrangement comprising at least one LED disposed on or in the associated plumbing fixture for directly illuminating at least one of the handle, the water flow, and an associated basin; and a sensor that produces at least one outout characteristic of at least one of:

a temperature of the externally accessible fluid flow, a flow rate of the externally accessible fluid flow, a position of a handle that controls the externally accessible fluid flow, and an ambient light intensity, further including a controller which effectuates a warning modulation of the LED arrangement responsive to an output of the sensor unit outside of a selected range.

9. The night light as set forth in claim 8, wherein the warning modulation includes a blinking of at least one element of the LED arrangement.

10. A night light for use in conjunction with an associated plumbing fixture including a spout and a handle for controlling a water flow from the spout, the night light comorising:

an LED arrangement comprising at least one LED disposed on or in the associated plumbing fixture for directly illuminating at least one of the handle, the water flow, and an associated basin; and a switch operatively communicating with the handle, the switch selectively energizing the LED arrangement responsive to a position of the handle.

11. The night light as set forth in claim 10, wherein the switch includes:

a control circuit that communicates with the handle and the LED arrangement to provide variable illumination responsive to a degree of opening of the handle.

12. A night light for use in conjunction with an associated plumbing fixture including a spout and a handle for controlling a water flow from the spout, the night light comprising:

an LED arrangement comprising at least one LED disposed on or in the associated plumbing fixture for directly illuminating at least one of the handle, the water flow, and an associated basin;

a substrate on which the LED arrangement is disposed; and an encapsulant that encapsulates the LED arrangement and at least a portion of the substrate.

13. The night light as set forth in claim 12, wherein the substrate includes a circuit board having electrical traces for electrically communicating with the LED arrangement.

14. The night light as set forth in claim 13, further including:

an ambient light sensor arranged on the circuit board and encapsulated by the encapsulant, the ambient light sensor electrically communicating with the LED arrangement to operate the LED based upon an ambient light sensor output.

15. A night light for use in conjunction with an associated plumbing fixture including a spout and a handle for controlling a water flow from the spout, the night light comprising:

an LED arrangement comprising at least one LED embedded in a light-transmissive portion of the plumbing fixture for directly illuminating at least one of the handle, the water flow, and an associated basin.

16. The night light as set forth in claim 15, wherein the LED arrangement includes:

an LED disposed in the handle, said handle being light transmissive.

17. A night light for use in conjunction with an associated plumbing fixture including a spout and a handle for controlling a water flow from the spout, the night light comprising:

an LED arrangement comprising at least one LED arranged on the spout of the associated plumbing fixture to illuminate the water flow.

18. The night light as set forth in claim 17, wherein the LED arrangement includes:

a detachable lower plate of the spout on which the at least one LED is arranged.

19. A plumbing fixture comprising:

a showerhead or a faucet, the showerhead or faucet including a water outlet for emitting a water flow and a handle for controlling the water flow;

at least one LED arranged on or in the showerhead or faucet and viewable by an associated user of the plumbing fixture;

a light-transmissive encapsulant that seals the at least one LED and transmits light produced by the at least one LED to the associated user; and a controller producing a controller output for controlling the LED light emission responsive to at least one of a water flow rate, a water flow temperature, an ambient light level, and a position of the handle.

20. The plumbing fixture as set forth in claim 19, further including:

one of a battery pack and a class II transformer arranged to power the at least one LED and the controller.

21. The plumbing fixture as set forth in claim 19, further including:

a printed circuit board on which the at least one LED is disposed, the printed circuit board including conductive traces operatively interconnecting the LED with the controller.

22. The plumbing fixture as set forth in claim 21, further including:

electrical power conditioning circuitry arranged on the printed circuit board for conditioning electrical power supplied to the at least one LED.

23. The plumbing fixture as set forth in claim 19, wherein the controller includes one of:

a switch operatively connected with the handle and producing an output responsive to a position of the handle, a flow sensor communicating with the water flow, a temperature sensor thermally communicating with the water flow, or a light sensor optically communicating with the ambient.

24. The plumbing fixture as set forth in claim 21, wherein the at least one LED further includes:

a plurality of LEDs cooperating with the controller to emit light including at least one of two or more colors of light responsive to the controller output.

25. A lamp adapted for arrangement on a faucet or showerhead including a spout and at least one handle for controlling a water flow out of the spout, the lamp comprising:

a printed circuit board with conductive traces arranged thereon;

an LED source including at least one LED arranged on the printed circuit board and electrically powered via the conductive traces; and a light-transmissive encapsulant sealing the LED source and the conductive traces, wherein the encapsulant defines a selected shape adapted for arrangement on the faucet.

26. The lamp as set forth in claim 25, wherein the encapsulant defines an annular or slotted form adapted for arrangement on a shaft on which the handle is disposed.

27. The lamp as set forth in claim 25, further including:

a light sensor arranged on the printed circuit board and encapsulated by the light-transmissive encapsulant, the photosensor optically communicating with the ambient and electrically communicating with the LED source to activate the LED source conditional upon a low ambient lighting criterion.

28. The lamp as set forth in claim 25, further including:

a battery pack adapted to transmit power supplied by an associated battery to power the LED source.

29. The lamp as set forth in claim 25, further including:

an inductively rechargeable battery electrically arranged to power the LED source.

30. The lamp as set forth in claim 25, further including:

electrical leads adapted to receive power from a class II power supply for powering the LED source.

31. The lamp as set forth in claim 25, further including:

a fastener attached to at least one of the printed circuit board and the light-transmissive encapsulant, the fastener adapted to detachably connect with the faucet or showerhead.

32. The lamp as set forth in claim 31, wherein the fastener includes a clamp adapted to detachably clamp onto a pipe on which the showerhead is disposed.

* * * * *